US012760669B2

(12) United States Patent
Pan et al.

(10) Patent No.: US 12,760,669 B2
(45) Date of Patent: Oct. 13, 2026

(54) ENGINE OIL COOLING STRUCTURE OF AN ENGINE

(71) Applicants: Jiangwei Pan, Taizhou City (CN); Qi Chen, Taizhou City (CN); Kangxin Mo, Taizhou City (CN); Licheng Zhang, Taizhou City (CN); Shujun Lin, Taizhou City (CN)

(72) Inventors: Jiangwei Pan, Taizhou City (CN); Qi Chen, Taizhou City (CN); Kangxin Mo, Taizhou City (CN); Licheng Zhang, Taizhou City (CN); Shujun Lin, Taizhou City (CN)

(73) Assignee: Zhejiang Qianjiang Motorcycle Co., Ltd., Taizhou City (CN)

( * ) Notice: Subject to any disclaimer, the term of this patent is extended or adjusted under 35 U.S.C. 154(b) by 0 days.

(21) Appl. No.: 18/996,987

(22) PCT Filed: Jul. 4, 2023

(86) PCT No.: PCT/CN2023/105625
§ 371 (c)(1),
(2) Date: Jan. 18, 2025

(87) PCT Pub. No.: WO2024/027442
PCT Pub. Date: Feb. 8, 2024

(65) Prior Publication Data

US 2026/0022649 A1 Jan. 22, 2026

(30) Foreign Application Priority Data

Aug. 2, 2022 (CN) ..... 202210923166.5

(51) Int. Cl.
*F01P 5/10* (2006.01)
*F01M 5/00* (2006.01)
(Continued)

(52) U.S. Cl.
CPC ..... *F01M 5/002* (2013.01); *F01M 11/02* (2013.01); *F01M 11/03* (2013.01); *F01P 3/18* (2013.01);
(Continued)

(58) Field of Classification Search
CPC .. F01M 11/03; F01M 2011/033; B01D 35/18; F01P 2060/04; F28D 2021/0089; F28F 27/02
(Continued)

(56) References Cited

U.S. PATENT DOCUMENTS 6,811,686 B1 * 11/2004 Sorce ..... B01D 35/18 210/186
8,312,857 B2 * 11/2012 Jessberger ..... F01M 11/0004 123/196 R
(Continued)

FOREIGN PATENT DOCUMENTS

CN 202673477 U 1/2013
CN 105401999 A 3/2016
(Continued)

OTHER PUBLICATIONS

International Search Report of PCT/CN2023/105625.

*Primary Examiner* — Logan M Kraft
*Assistant Examiner* — James J Kim
(74) *Attorney, Agent, or Firm* — Minder Law Group; Willy H. Wong

(57) ABSTRACT

The present disclosure provides an engine oil cooling structure of an engine. In the engine oil cooling structure of an engine, the engine includes a crankcase, the crankcase is provided with an oil filter mounting chamber having a cylindrical shape, the cooling structure includes a water channel, a water inlet of the water channel communicates with a water pump, the crankcase is further provided with a
(Continued)

main oil channel, the crankcase is further provided with a heat conducting thin wall, an inner cavity of the heat conducting thin wall form the oil filter mounting chamber, the oil filter mounting chamber communicates with the main oil channel, the water channel is arranged around an outer side wall of the heat conducting thin wall, and a water outlet of the water channel communicates with a cooling water channel arranged in the same direction as and adjacent to the main oil channel.

7 Claims, 9 Drawing Sheets

(51) Int. Cl.

| | |
|---|---|
| ***F01M 11/02*** | (2006.01) |
| ***F01M 11/03*** | (2006.01) |
| ***F01P 3/18*** | (2006.01) |
| ***F01P 3/20*** | (2006.01) |

(52) U.S. Cl.
CPC *F01P 3/20* (2013.01); *F01P 5/10* (2013.01); *F01M 2011/026* (2013.01); *F01P 2060/04* (2013.01)

(58) Field of Classification Search
USPC ..... 123/41.44
See application file for complete search history.

(56) References Cited

U.S. PATENT DOCUMENTS

| | | | | |
|---|---|---|---|---|
| 9,587,532 | B1 * | 3/2017 | Au | F01M 5/002 |
| 9,664,077 | B2 * | 5/2017 | Zahdeh | F01M 5/001 |
| 2003/0098203 | A1 * | 5/2003 | Kunimitsu | F01M 11/02 184/6.5 |
| 2025/0243797 | A1 * | 7/2025 | Yamada | F01P 3/02 |

FOREIGN PATENT DOCUMENTS

| | | | |
|---|---|---|---|
| CN | 105697100 | A | 6/2016 |
| CN | 206190354 | U | 5/2017 |
| CN | 106194423 | A | 6/2019 |
| CN | 209308784 | U | 8/2019 |
| CN | 214577271 | U | 11/2021 |
| CN | 115182802 | A | 10/2022 |
| CN | 217632605 | U | 10/2022 |
| JP | 2015045272 | A | 3/2015 |

* cited by examiner

B–B

ENGINE OIL COOLING STRUCTURE OF AN ENGINE

RELATED APPLICATIONS

This application claims priority to PCT Patent Application No. PCT/CN2023/105625 filed Jul. 4, 2023 and China Patent Application No. CN202210923166.5 filed Aug. 2, 2022.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present disclosure belongs to the technical field of engines, and relates to an engine oil cooling structure of an engine.

BACKGROUND

An engine lubrication system functions to continuously deliver a sufficient amount of clean engine oil with an appropriate temperature to friction surfaces of kinematic pairs of all transmission parts during operation of an engine, and form an oil film between the friction surfaces to achieve liquid friction, thereby reducing frictional resistance, reducing power consumption, and reducing wear of machine parts, so as to achieve the object of improving the operational reliability and durability of the engine. Generally, a lubricating oil path is disposed in the engine to deliver the engine oil, however, during operation of the engine, heat will be generated. The heat will be transmitted to the engine oil, which causes the temperature of the engine oil to rise. When the temperature of the engine oil is too high, the engine oil will become thin, leading to a decrease in lubrication capacity. This factor causes the engine to not operate properly because the lubricating effect can't keep up. Therefore, the conventional engine is generally provided with an engine oil cooler (simply referred to as an oil cooler) in the lubricating oil path for cooling the engine oil.

A patent Application document with Publication No.: CN105697100A discloses an engine with an engine oil filter cooler, including an engine body, a cooling water channel communicating with a water jacket of the engine body, an engine oil cooling water tank for receiving cooling water from the engine body, an oil filter for filtering engine oil in a lubricating oil path of the engine body and disposed in the engine oil cooling water tank, and a control valve for controlling cooling water to enter the engine oil cooling water tank through the cooling water channel. Cooling water is provided by an oil cooler.

In the above engine, the engine oil circulates in the lubricating oil path and the oil filter, when the engine oil is filtered through the oil filter, cooling water in the engine oil cooling water tank will cool engine oil in the oil filter to improve the cooling effect, but engine oil flowing out of the oil filter to re-enter the lubricating oil path will be continued to be heated under the action of conduction of the heat of the engine, and it is not easy to ensure that low-temperature engine oil eventually flows to a kinematic pair. In order to ensure a low temperature state when the engine oil eventually flows to the kinematic pair, it is a common practice to increase the number of oil coolers or change the oil cooler to a more powerful oil cooler to provide cooling water having a lower temperature, thereby increasing the cooling effect of cooling water in the engine oil cooling water tank on the engine oil and further reducing the temperature of the engine oil when the engine oil flows out of the oil filter.

SUMMARY

For the above problems in the prior art, the present disclosure provides an engine oil cooling structure of an engine. The technical problem to be solved by the present disclosure is to achieve better engine oil cooling effects while saving costs.

An object of the present disclosure can be achieved by the following technical solution:

provided is an engine oil cooling structure of an engine, the engine including a crankcase, the crankcase being provided with an oil filter mounting chamber having a cylindrical shape, the cooling structure including a water channel, a water inlet of the water channel communicating with a water pump, the crankcase being further provided with a main oil channel, wherein the crankcase is further provided with a heat conducting thin wall, an inner cavity of the heat conducting thin wall forms the oil filter mounting chamber, the oil filter mounting chamber communicates with the main oil channel, the water channel is arranged around an outer side wall of the heat conducting thin wall, and a water outlet of the water channel communicates with a cooling water channel arranged in the same direction as and adjacent to the main oil channel.

The oil filter mounting chamber is configured to receive an oil filter, the oil filter can perform fine filtration on engine oil flowing through the oil filter to prevent damage caused by impurity particles flowing to each kinematic pair with the engine oil, the water channel communicates with the water pump, cooling water flowing through the water channel can absorb heat from the engine oil inside the oil filter mounting chamber to lower the temperature of the engine oil, and the main oil channel is a main channel through which pressurized engine oil flows to various places after filtration. The oil filter mounting chamber communicates with the main oil channel, the oil filter mounting chamber is formed by the inner cavity of the heat conducting thin wall, the water channel is arranged around the outer side wall of the heat conducting thin wall, the oil filter mounting chamber is separated from the water channel by the heat conducting thin wall, and the cooling water channel communicating with the water outlet of the water channel is arranged in the same direction as and adjacent to the main oil channel, so that after engine oil is initially cooled by cooling water in the water channel, the cooled engine oil can be continuously cooled by cooling water in the cooling water channel after flowing out of the oil filter mounting chamber and entering the main oil channel, which facilitates the adjustment of the temperature of the engine oil without the need of an additional oil cooler or with the provision of an oil cooler with a less power only, thereby saving costs under the condition that the temperature of the engine oil is reduced.

In the engine oil cooling structure of an engine described above, an outer side wall of the heat conducting thin wall is provided with heat radiating fins disposed along an axial direction of the oil filter mounting chamber. In this way, improvement of the heat exchange effect between the engine oil in the oil filter mounting chamber and the cooling water in the water channel is facilitated, further ensuring the engine oil cooling effect.

In the engine oil cooling structure of an engine described above, one end of the oil filter mounting chamber has an open shape disposed outwardly. In this way, it is convenient for users to disassemble and assemble the oil filter from the outside, improving the convenience of maintenance while ensuring the cooling effect.

In the engine oil cooling structure of an engine described above, the water inlet and the water outlet of the water channel are respectively arranged close to both axial ends of the oil filter mounting chamber. In this way, cooling water flowing into the water channel from the water pump can flow sufficiently to sufficiently absorb heat emitted from engine oil to avoid heat accumulation.

In the engine oil cooling structure of an engine described above, a plurality of the heat radiating fins are provided and circumferentially spaced around the outer side wall of the heat conducting thin wall. In this way, the heat radiating fins can guide cooling water in the water channel, so that multiple streams of the cooling water flow orderly in an axial direction of a side wall of the oil filter mounting chamber, thereby ensuring uniform heat exchange of the cooling water, thereby improving the cooling effect.

In the engine oil cooling structure of an engine described above, the water channel covers an outer surface of the heat conducting thin wall at the other end of the oil filter mounting chamber, and the heat radiating fins extend onto the outer surface of the heat conducting thin wall at the other end of the oil filter mounting chamber. After the engine oil is filtered, the filtered engine oil will be discharged from the other end of the oil filter mounting chamber, so that the cooling water in the water channel can be further subjected to heat exchange around an outer circumference of the engine oil at the heat conducting thin wall of the other end of the oil filter mounting chamber, thereby improving the cooling effect.

In the engine oil cooling structure of an engine described above, the engine further includes a combustion cylinder connected to the crankcase, and the main oil channel and the cooling water channel are located in the crankcase and arranged close to the combustion cylinder. In this way, a design arrangement of a shorter path in which the cooling water channel communicates with a water jacket of the combustion cylinder is facilitated, ensuring a sufficient cooling effect.

In the engine oil cooling structure of an engine described above, an inner wall of the main oil channel is provided with lubricating oil channels communicating with revolute pairs of a crankshaft, a cavity having a bar shape and arranged in the same direction as the main oil channel is formed between the main oil channel and a middle section of the cooling water channel, and a position of the lubricating oil channel closest to the oil filter mounting chamber in a direction in which the main oil channel is disposed is opposite to a position of the cavity. If there is no cavity, when the engine oil flows into each lubricating oil channel, due to the heat conduction of the engine, the temperature of the engine oil farther away from the mounting chamber is higher, and the temperature of the engine oil closer to the oil filter mounting chamber is lower, and the temperature difference of the engine oil in each lubricating oil channel is larger. On one hand, the cavity may reduce the weight of the entire crankcase, on the other hand, the cavity can also appropriately reduce the heat exchange efficiency between a cooling water flow and the engine oil in the main oil channel at the middle section of the cooling water channel, in this way, the engine oil preliminarily cooled in the main oil channel will be slowly cooled or even gradually heated by the cavity, the engine oil enters one lubricating oil channel communicating with the revolute pair of the crankshaft at a lower temperature, the engine oil in the main oil channel is directly cooled by a cold water flow in the cooling water channel after passing through a region of the cavity, the temperature of the engine oil continues to decrease, and then, when the engine oil enters another lubricating oil channel, the temperature of the engine oil may be less different from the temperature of the engine oil entering the first lubricating oil channel, ensuring that the temperature of the engine oil participating in the lubrication is closer, and ensuring that the lubrication effect is stable and consistent.

Compared with the prior art, the advantages of the present disclosure are as follows:

According to the engine oil cooling structure of an engine, after the engine oil is initially cooled by cooling water in the water channel, the cooled engine oil can be continuously cooled by cooling water in the cooling water channel after entering the main oil channel, which facilitates the adjustment of the temperature of the engine oil without the need of an additional oil cooler or with the provision of an oil cooler with a less power only, thereby saving costs under the condition that the temperature of the engine oil is reduced. Moreover, due to the provision of the cavity, the temperature difference of the engine oil can be reduced when the engine oil flows into each lubricating oil channel, thereby ensuring the consistency and stability of the lubricating effect.

Figure 1:
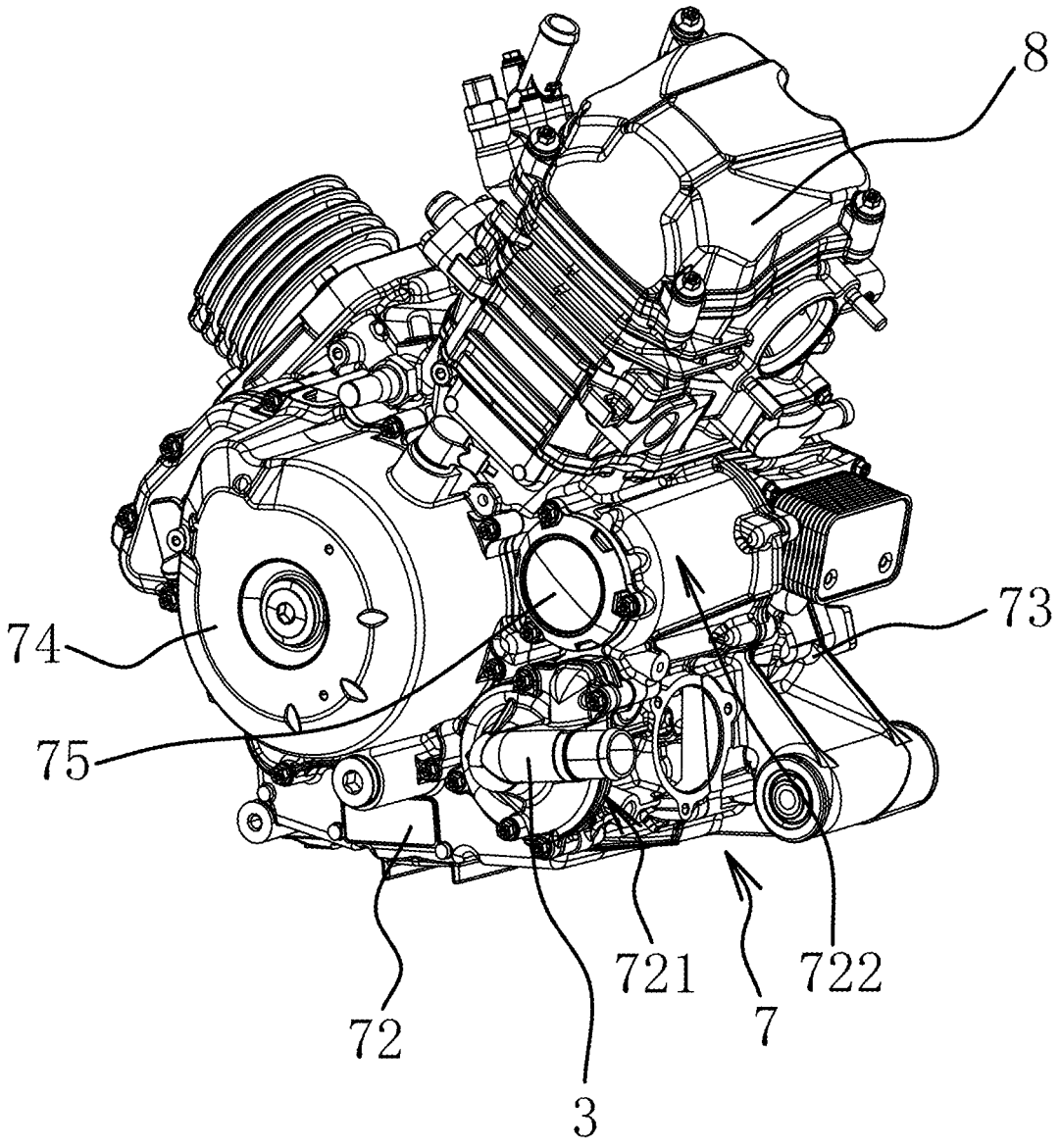
FIG. 1 is a schematic perspective structural view of an engine in one embodiment.

In the drawings, 1, oil filter mounting chamber; 2, water channel; 21, water inlet; 22, water outlet; 3, water pump;

4, main oil channel; 41, lubricating oil channel;

5, cooling water channel; 6, heat radiating fin;

7, crankcase; 71, heat conducting thin wall; 72, front body; 721, water pump installation position; 722, oil filter mounting position; 723, crankshaft front mounting position; 73, rear body; 74, crankshaft cover; 75, oil filter cover;

8, combustion cylinder; 9, cavity; 10, crankshaft; and 11, oil filter.

DETAILED DESCRIPTION

The following are specific embodiments of the present disclosure and the technical solutions of the present disclosure are further described with reference to the accompanying drawings, but the present disclosure is not limited to these embodiments.

Figure 2:
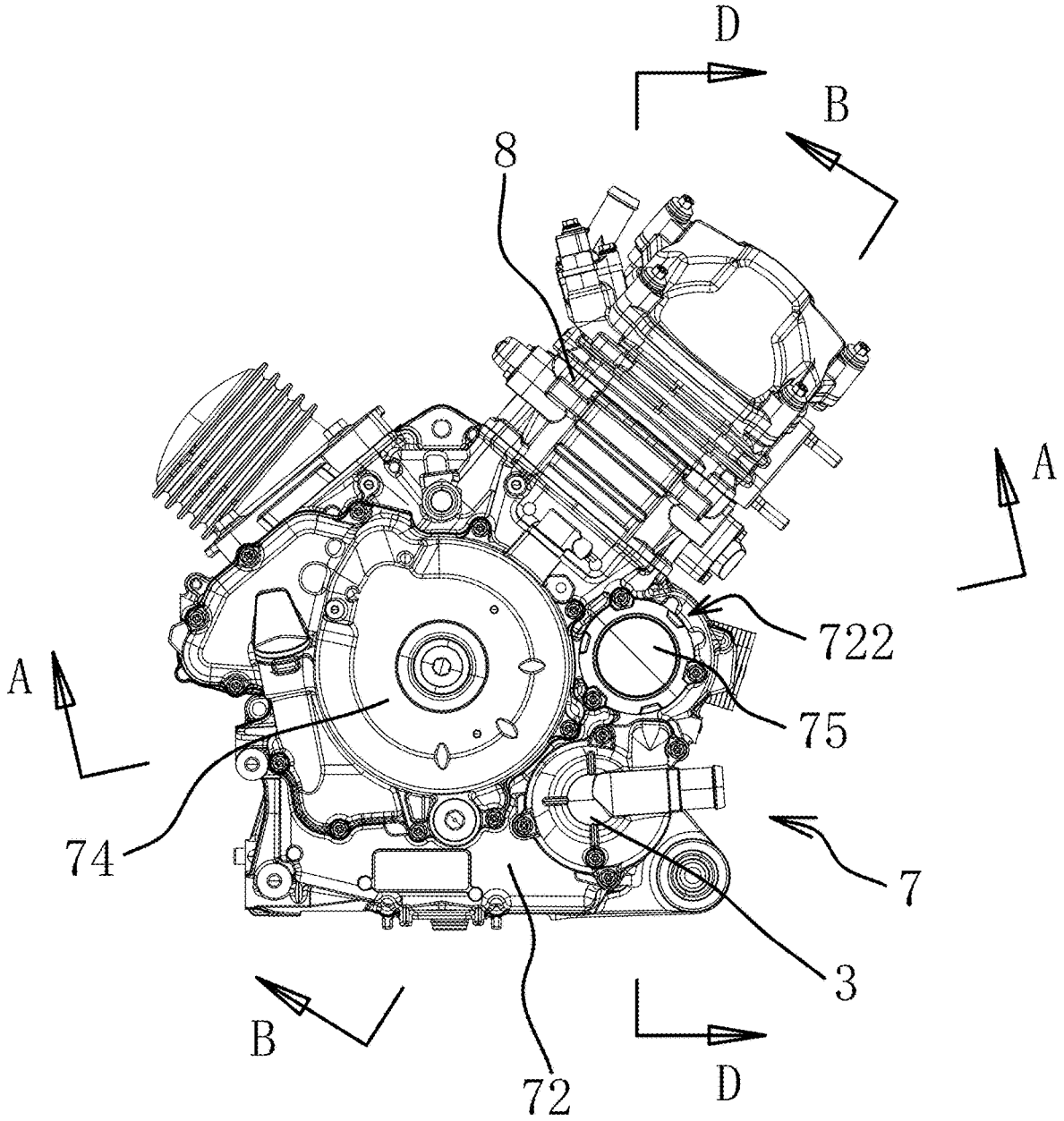
FIG. 2 is a schematic front structural view of the engine in one embodiment.
Figure 8:
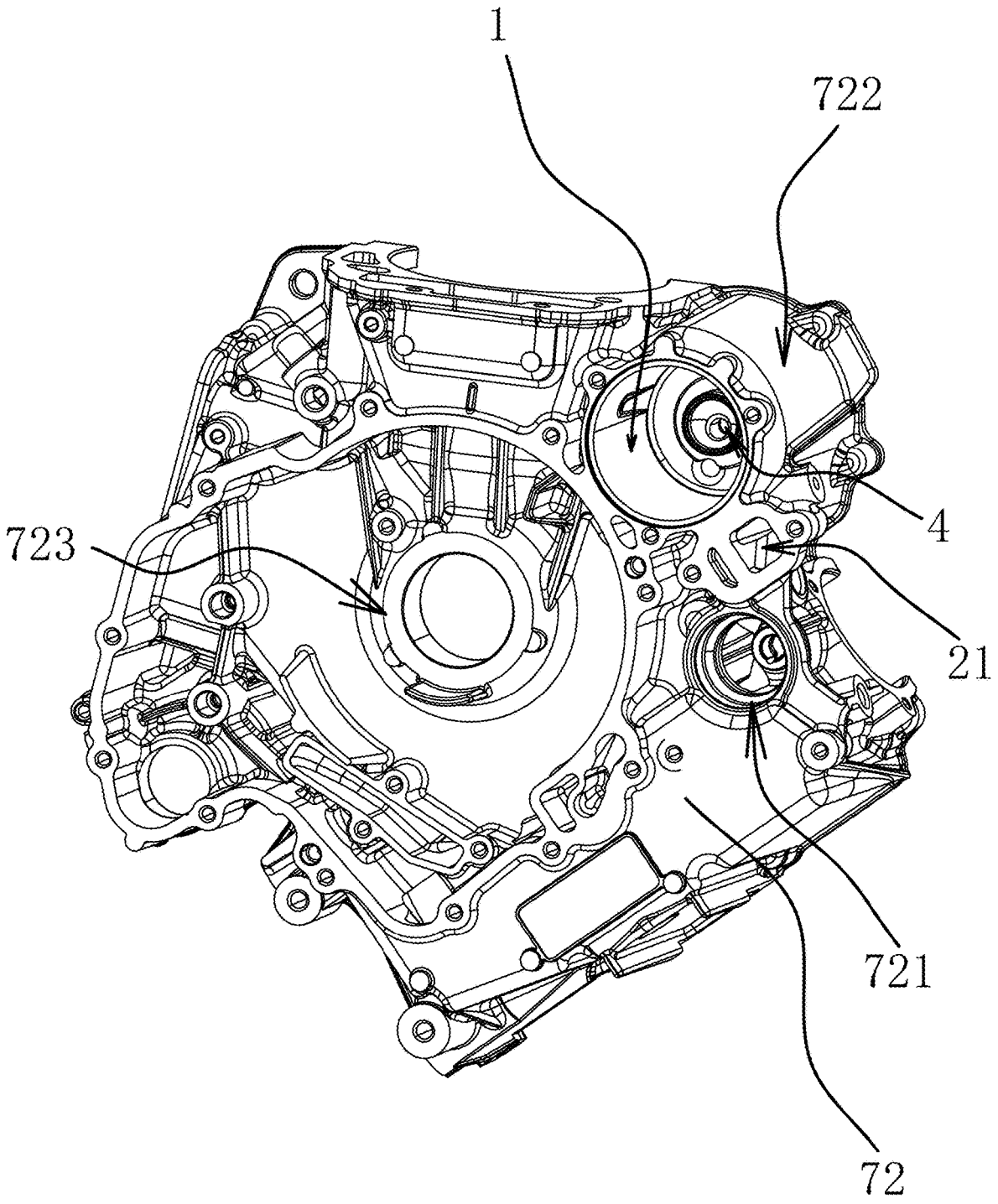
FIG. 8 is a schematic partial perspective structural view of a front body of a crankcase in one embodiment.

As shown in FIGS. 1, 2 and 8, in an engine oil cooling structure of an engine, the engine includes a crankcase 7 and a combustion cylinder 8 connected to the crankcase 7, and the crankcase 7 includes a front body 72 and a rear body 73 which are split together and fixed. The crankcase 7 is provided with a rotatable crankshaft 10 in a penetrating manner, the front body 72 is provided with a crankshaft front mounting position 723, a front end of the crankshaft 10 is disposed at the crankshaft front mounting position 723 in a penetrating manner, a crankshaft cover 74 is fixed to the crankshaft front mounting position 723, and a rear end of the crankshaft 10 extends out of the rear body 73. A position, located at a lower right side of the crankshaft front mounting position 723, of the front body 72 is provided with a water pump installation position 721, the water pump installation position 721 is fixedly connected with a water pump 3, a position, located at a right side of the crankshaft front mounting position 723, of the front body 72 is provided with an oil filter mounting position 722, and the oil filter mounting position 722 is fixedly connected with a removable oil filter cover 75. The combustion cylinder 8 is fixedly connected to an upper end of the crankcase 7 and is inclined to the right.

Figure 3:
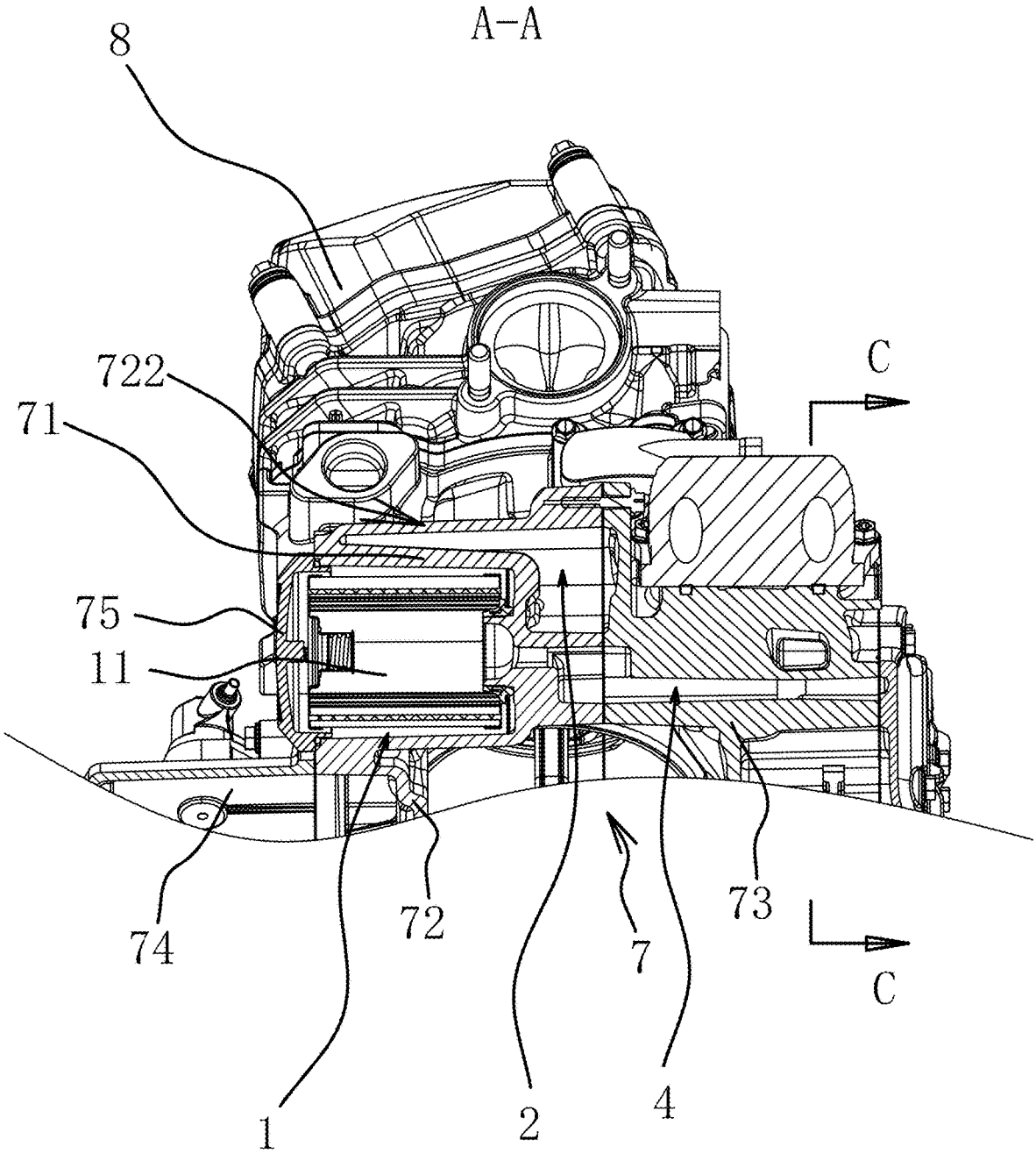
FIG. 3 is a schematic partial cross-sectional structural view taken along a direction A-A of FIG. 2.

As shown in FIGS. 3 and 8, the oil filter mounting position 722 is provided with an oil filter mounting chamber 1 having a cylindrical shape. As shown in FIGS. 3 to 7, the cooling structure includes a water channel 2, a water inlet 21 of the water channel 2 communicates with the water pump 3 (see a dashed line at a lower right side of FIG. 6), the engine is provided with a main oil channel 4 for delivering engine oil to each component, the oil filter mounting position 722 of the crankcase 7 is further provided with a heat conducting thin wall 71, an inner cavity of the heat conducting thin wall 71 forms the oil filter mounting chamber 1, the water channel 2 is arranged around an outer periphery of the heat conducting thin wall 71, the oil filter mounting chamber 1 communicates with the main oil channel 4, and a water outlet 22 of the water channel 2 communicates with a cooling water channel 5 arranged in the same direction as and adjacent to the main oil channel 4. The oil filter mounting chamber 1 is configured to receive an oil filter 11, the oil filter 11 can perform fine filtration on engine oil flowing through the oil filter 11 to prevent damage caused by impurity particles flowing to each kinematic pair with the engine oil, the water channel 2 communicates with the water pump 3, the water pump 3 is an existing product, cooling water flowing through the water channel 2 can absorb heat from the engine oil inside the oil filter mounting chamber 1, thereby lowering the temperature of the engine oil, and the main oil channel 4 is a main channel through which pressurized engine oil flows to various places after filtration; and the oil filter mounting chamber 1 communicates with the main oil channel 4, and the cooling water channel 5 communicating with the water channel 2 is arranged in the same direction as and adjacent to the main oil channel 4, so that after engine oil is initially cooled by cooling water in the water channel 2, the cooled engine oil can be continuously cooled by the cooling water in the cooling water channel 5 after entering the main oil channel 4, which facilitates the adjustment of the temperature of the engine oil without the need of an additional oil cooler or with the provision of an oil cooler with a less power only, thereby saving costs under the condition that the temperature of the engine oil is reduced.

Figure 4:
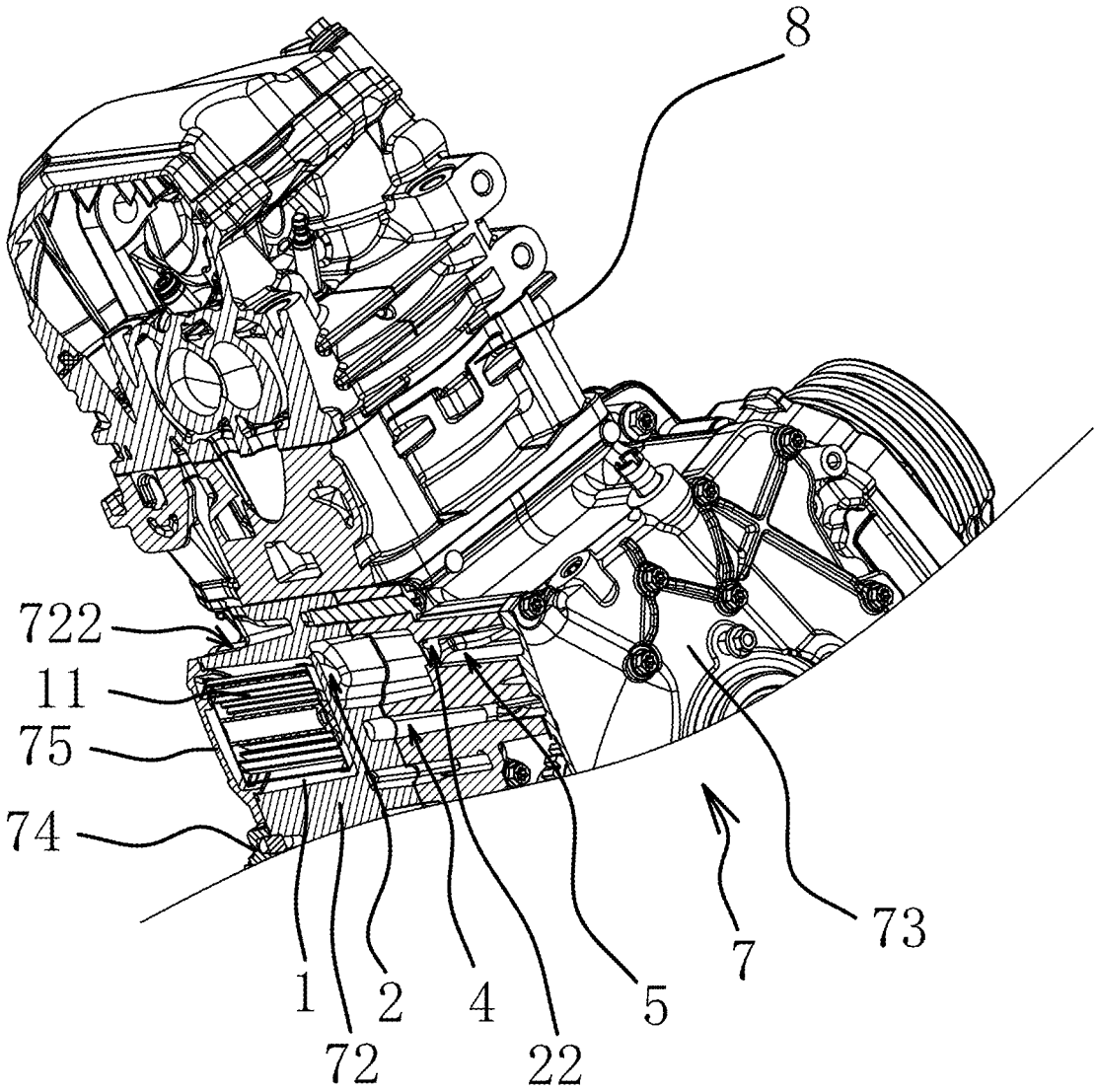
FIG. 4 is a schematic partial cross-sectional structural view taken along a direction B-B of FIG. 2.
Figure 5:
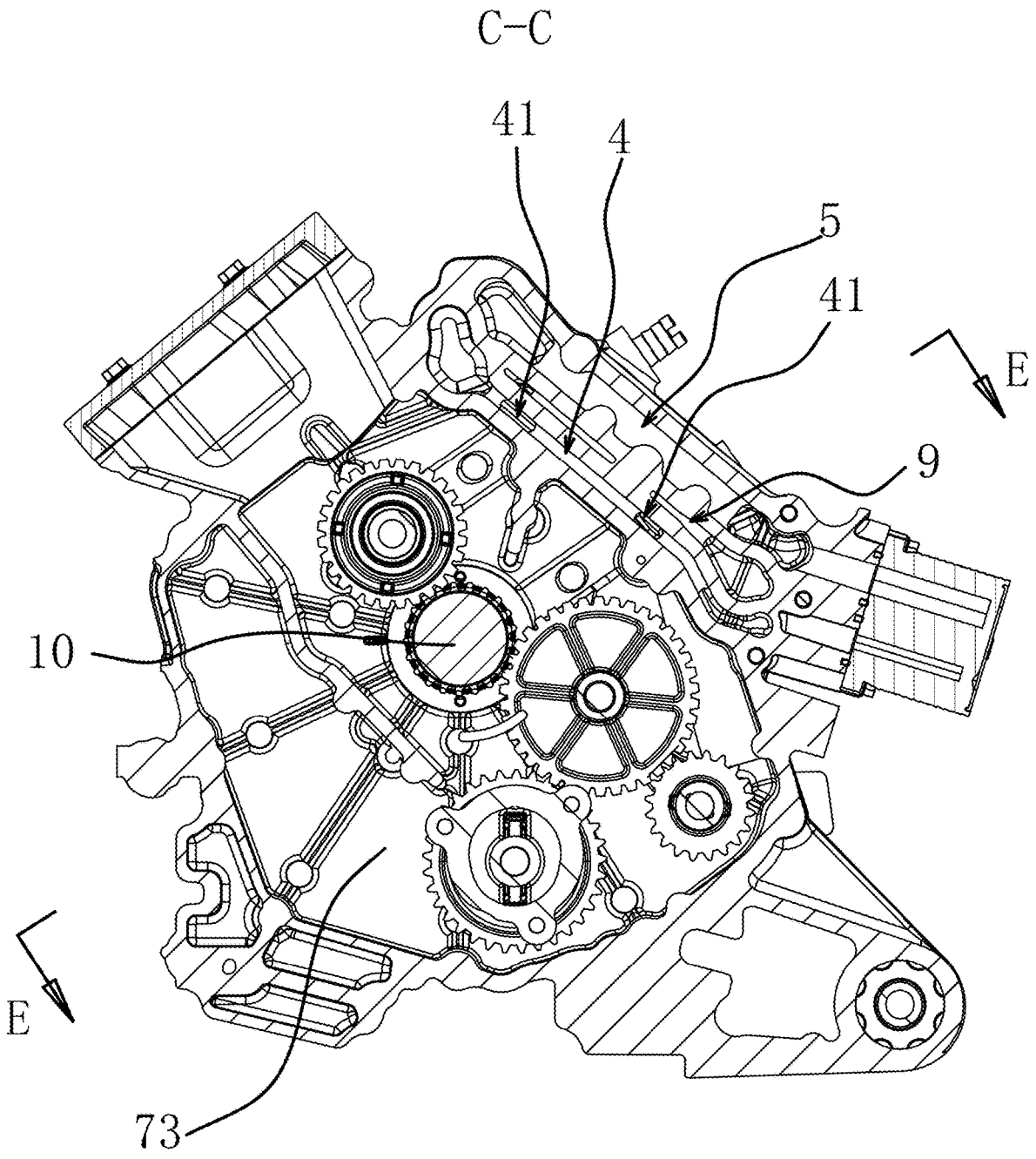
FIG. 5 is a schematic cross-sectional structural view taken along a direction C-C of FIG. 3.
Figure 6:
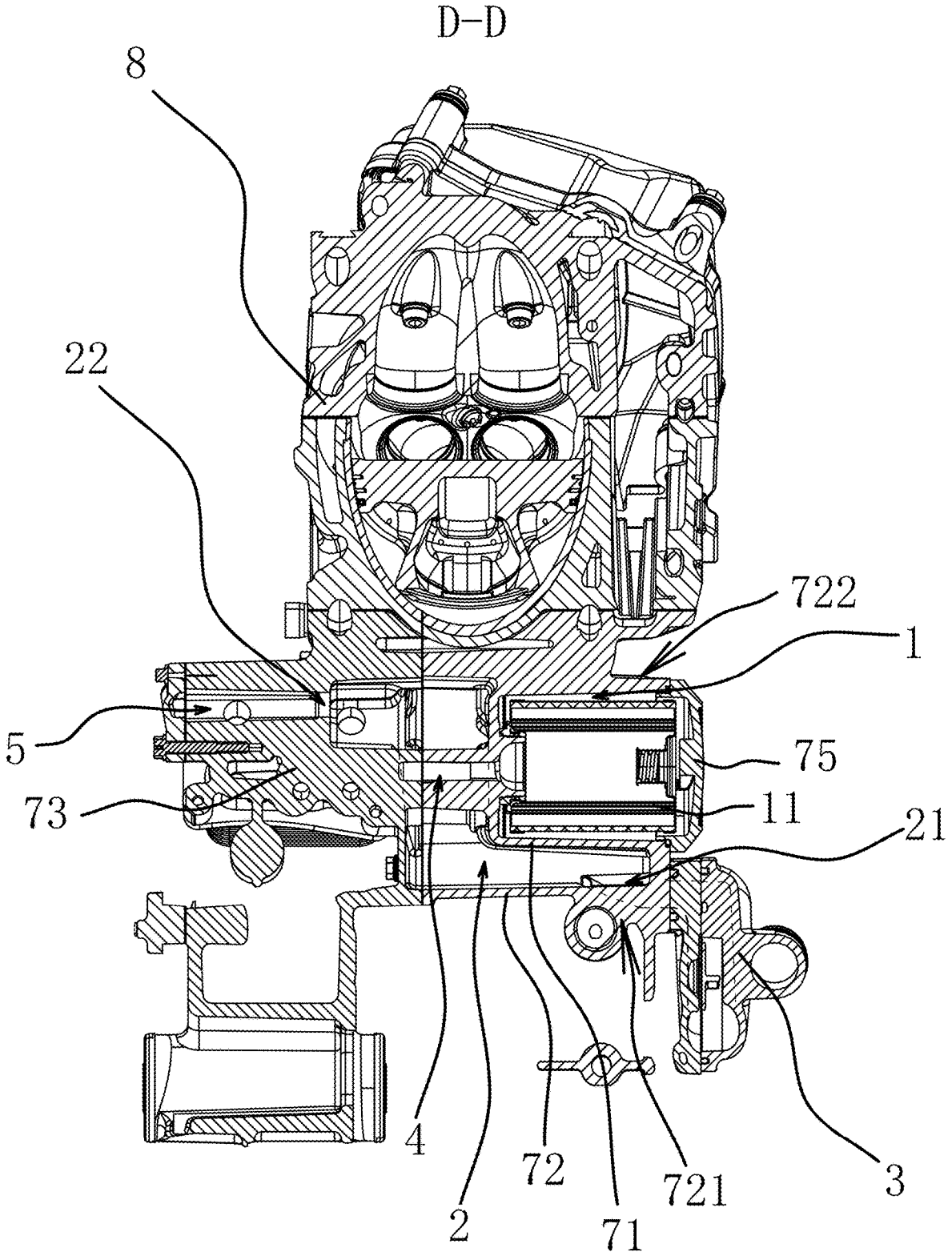
FIG. 6 is a schematic cross-sectional structural view taken along a direction D-D of FIG. 2.
Figure 7:
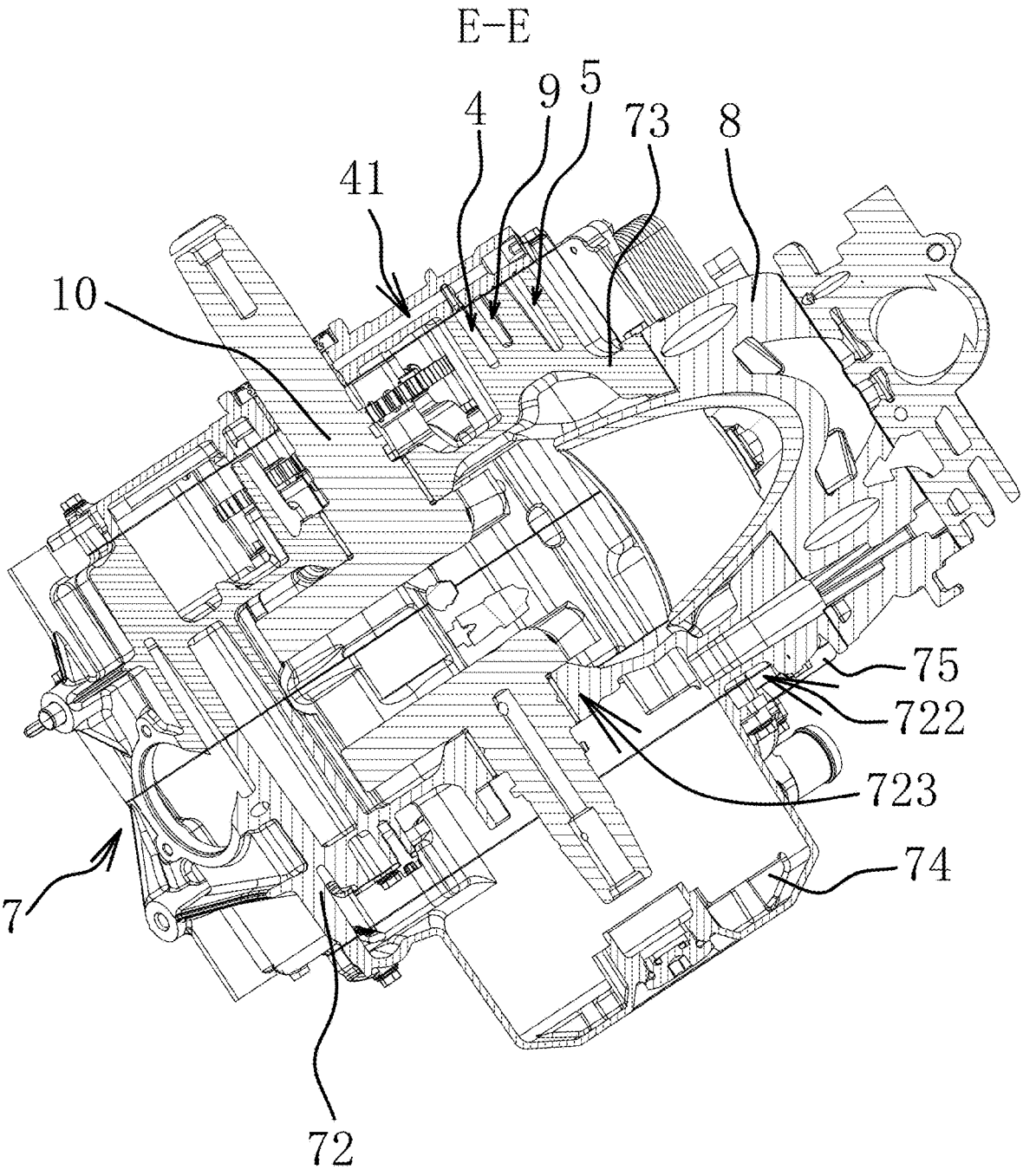
FIG. 7 is a schematic cross-sectional structural view taken along a direction E-E of FIG. 5.

Specifically, as shown in FIGS. 3 and 6, one end of the oil filter mounting chamber 1 has an open shape disposed outwardly, and is an outer end of the oil filter mounting chamber 1, the oil filter 11 is inserted from the outer end of the oil filter mounting chamber 1, the outer end of the oil filter mounting chamber 1 is closed by the removable oil filter cover 75, and the oil filter 11 is fixed in the oil filter mounting chamber 1. In this way, it is convenient for users to disassemble and assemble the oil filter 11 from the outside, improving the convenience of maintenance while ensuring the cooling effect. As shown in FIG. 6, the water inlet 21 and the water outlet 22 of the water channel 2 are respectively arranged close to both axial ends of the oil filter mounting chamber 1. In this way, cooling water flowing into the water channel 2 from the water pump 3 can flow sufficiently to sufficiently absorb heat emitted from engine oil to avoid heat accumulation. As shown in FIG. 4, the main oil channel 4 and the cooling water channel 5 are located inside the crankcase 7 and arranged close to the combustion cylinder 8. In this way, a design arrangement of a shorter path in which the cooling water channel 5 communicates with a water jacket of the combustion cylinder 8 is facilitated, ensuring a sufficient cooling effect. As shown in FIGS. 3 and 4, the other end of the oil filter mounting chamber 1 (i.e., an inner end of the oil filter mounting chamber 1) communicates with the main oil channel 4 approximately at a center of the inner end of the oil filter mounting chamber 1. The main oil channel 4 extends rearwardly first and into the rear body 73, then continues to extend rearwardly for a certain distance in the rear body 73, and as shown in connection with FIG. 5, the main oil channel 4 then extends leftward in the rear body 73. As shown in FIGS. 3 and 4, the water outlet 22 of the water channel 2 is disposed in the rear body 73, the cooling water channel 5 extends rearward in the rear body 73, as shown in connection with FIG. 5, the cooling water channel 5 then extends leftward in the rear body 73, and the cooling water channel 5 is arranged in the same direction as and adjacent to the main oil channel 4. As shown in FIG. 5, an inner wall of the main oil channel 4 is provided with a plurality of lubricating oil channels 41 communicating with revolute pairs of the crankshaft 10, and a cavity 9 having a bar shape and arranged in the same direction as the main oil channel 4 is formed between the main oil channel 4 and a middle section of the cooling water channel 5 in the rear body 73 of the crankcase 7. As shown in connection with FIG. 7, a position of the lubricating oil channel 41 closest to the oil filter mounting chamber 1 in a direction in which the main oil channel 4 extends is opposite to a position of the cavity 9. The cavity 9 can reduce the heat exchange efficiency with the main oil channel 4 in the middle section of the cooling water channel 5, in this way, the engine oil preliminarily cooled in the main oil channel 4 will be slowly cooled or even gradually heated, the engine oil enters one lubricating oil channel 41 (i.e., a first lubricating oil channel 41) communicating with the revolute pair of the crankshaft 10 at a lower temperature, the engine oil in the main oil channel 4 can continue to be cooled directly by the cooling water in the cooling water channel 5 after passing through a region of the cavity 9, the temperature of the engine oil continues to decrease, and then, when the engine oil enters another lubricating oil channel 41, the temperature of the engine oil may be less different from the temperature of the engine oil entering the first lubricating oil channel 41, ensuring that the temperature of the engine oil participating in the lubrication is closer, and ensuring that the lubrication effect is stable and consistent.

Figure 9:
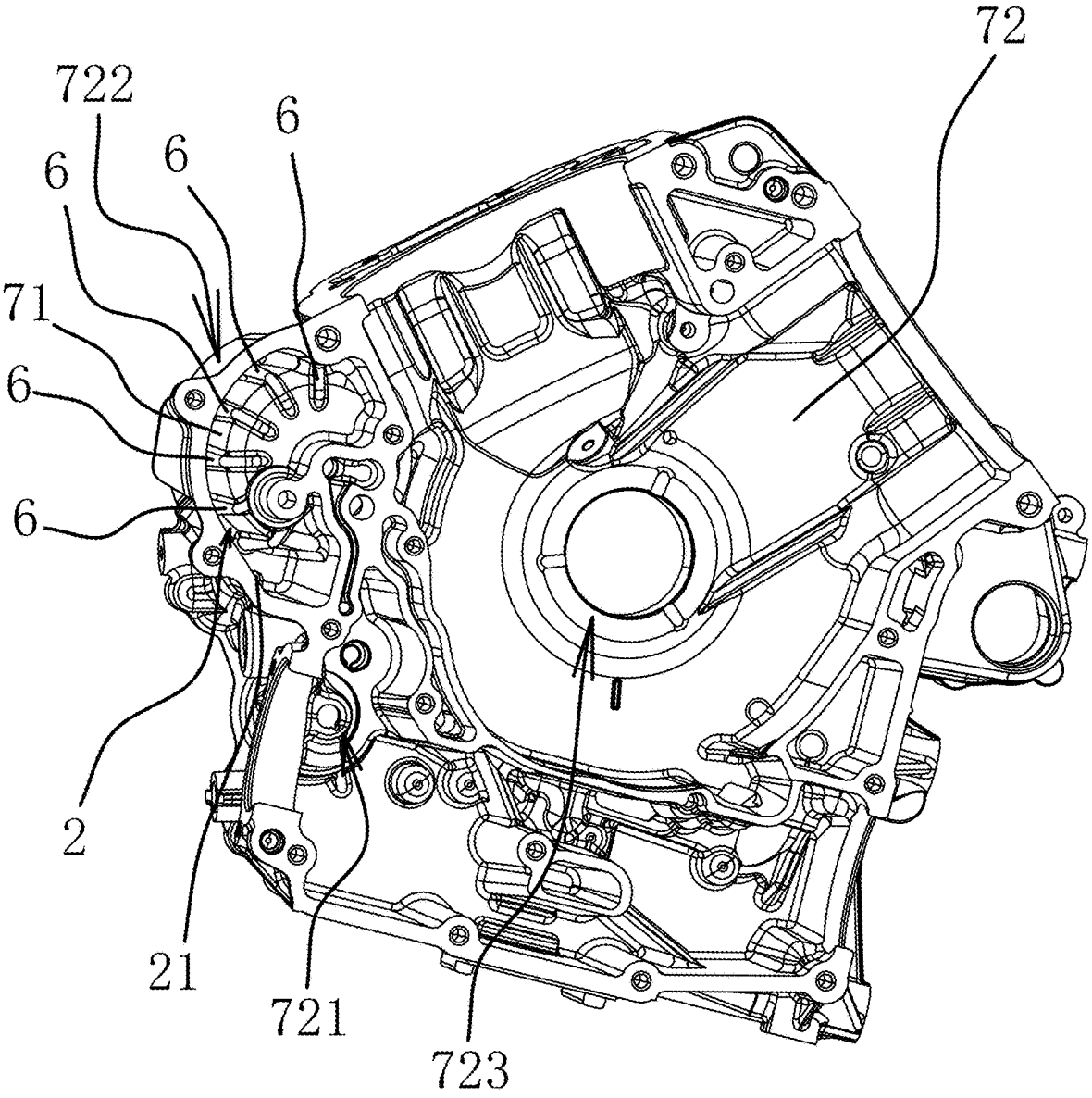
FIG. 9 is a schematic partial perspective structural view of the front body of the crankcase in one embodiment from another perspective.

As shown in FIGS. 3, 6 and 9, the heat conducting thin wall 71 is disposed on the front body 72 of the crankcase 7, and an outer side wall of the heat conducting thin wall 71 is provided with heat radiating fins 6 disposed in an axial direction of the oil filter mounting chamber 1. In this way, improvement of the heat exchange effect between the engine oil in the oil filter mounting chamber 1 and the cooling water in the water channel 2 is facilitated, further ensuring the engine oil cooling effect. Six heat radiating fins 6 are provided and are circumferentially spaced around the outer side wall of the heat conducting thin wall 71. In this way, the heat radiating fins 6 can guide cooling water in the water channel 2, so that multiple streams of the cooling water flow orderly in an axial direction of a side wall of the oil filter mounting chamber 1, thereby ensuring uniform heat exchange of the cooling water, improving the cooling effect. The water channel 2 covers an outer surface of the heat conducting thin wall 71 at the other end of the oil filter mounting chamber 1 (i.e., the inner end of the oil filter mounting chamber 1), and the heat radiating fins 6 extend onto the outer surface of the heat conducting thin wall 71 at the other end of the oil filter mounting chamber 1. After the engine oil is filtered, the filtered engine oil will be discharged from the other end of the oil filter mounting chamber 1, so that the cooling water in the water channel 2 can be further subjected to heat exchange around an outer circumference of the engine oil flowing out, thereby improving the cooling effect.

The specific embodiments described herein are merely illustrative of the spirit of the present disclosure. Those skilled in the art to which the present disclosure belongs may make various modifications or supplements or similar substitutions to the specific embodiments described without departing from the spirit of the present disclosure or being beyond the scope defined by the appended claims.

What is claimed is:

1. An engine oil cooling structure of an engine, the engine comprising a crankcase, the crankcase being provided with an oil filter mounting chamber having a cylindrical shape, the cooling structure comprising a water channel, a water inlet of the water channel communicating with a water pump, the crankcase being provided with a main oil channel for conveying engine oil, wherein the crankcase is further provided with a heat conducting thin wall, an inner cavity of the heat conducting thin wall forms the oil filter mounting chamber, the oil filter mounting chamber communicates with the main oil channel, the water channel is arranged around an outer side wall of the heat conducting thin wall, and a water outlet of the water channel communicates with a cooling water channel arranged in the same direction as and adjacent to the main oil channel; and wherein an inner wall of the main oil channel is provided with lubricating oil channels communicating with revolute pairs of a crankshaft, a cavity having a bar shape and arranged in the same direction as the main oil channel is formed between the main oil channel and a middle section of the cooling water channel, and a position of the lubricating oil channel closest to the oil filter mounting chamber in a direction in which the main oil channel is disposed is opposite to a position of the cavity.

2. The engine oil cooling structure of an engine as claimed in claim 1, wherein the water inlet and the water outlet of the water channel are respectively arranged close to both axial ends of the oil filter mounting chamber.

3. The engine oil cooling structure of an engine as claimed in claim 1, wherein the engine further comprises a combustion cylinder connected to the crankcase, and the main oil channel and the cooling water channel are located in the crankcase and arranged close to the combustion cylinder.

4. The engine oil cooling structure of an engine as claimed in claim 1, wherein an outer side wall of the heat conducting thin wall is provided with heat radiating fins disposed along an axial direction of the oil filter mounting chamber.

5. The engine oil cooling structure of an engine as claimed in claim 4, wherein a first end of the oil filter mounting chamber has an open shape disposed outwardly.

6. The engine oil cooling structure of an engine as claimed in claim 4, wherein a plurality of the heat radiating fins are provided and circumferentially spaced around the outer side wall of the heat conducting thin wall.

7. The engine oil cooling structure of an engine as claimed in claim 5, wherein the water channel covers an outer surface of the heat conducting thin wall at a second end of the oil filter mounting chamber, and the heat radiating fins extend onto the outer surface of the heat conducting thin wall at the second end of the oil filter mounting chamber.

* * * * *